US005277162A

United States Patent [19]

Smith et al.

[11] Patent Number: 5,277,162

[45] Date of Patent: Jan. 11, 1994

[54] INFINITELY VARIABLE HYDROMECHANICAL TIMING CONTROL

[75] Inventors: Edward D. Smith, Greensburg; David L. Buchanan, Westport; Lester L. Peters, Columbus, all of Ind.

[73] Assignee: Cummins Engine Company, Inc., Columbus, Ind.

[21] Appl. No.: 7,973

[22] Filed: Jan. 22, 1993

[51] Int. Cl.[5] ..... F02M 37/04

[52] U.S. Cl. ..... 123/446; 123/456

[58] Field of Search ..... 123/446, 456, 500, 501, 123/502

[56] References Cited

U.S. PATENT DOCUMENTS

| | | | |
|---|---|---|---|
| 3,486,492 | 11/1969 | Lehnerer . | |
| 4,408,591 | 10/1983 | Nakamura | 123/502 |
| 4,440,132 | 4/1984 | Terada et al. | 123/500 |
| 4,541,385 | 9/1985 | Eheim et al. | 123/446 |
| 4,593,664 | 6/1986 | Omori et al. | 123/446 |
| 4,621,605 | 11/1986 | Carey, Jr. et al. | 123/446 |
| 4,628,881 | 12/1986 | Beck et al. | 123/446 |
| 4,712,528 | 12/1987 | Schaffitz | 123/446 |
| 4,721,247 | 1/1988 | Perr | 239/91 |
| 4,869,219 | 9/1989 | Bremmer et al. | 123/383 |
| 4,909,219 | 3/1990 | Perr et al. | 123/456 |
| 4,986,472 | 1/1991 | Warlick et al. | 39/88 |
| 5,042,445 | 8/1991 | Peters et al. | 123/446 |
| 5,176,115 | 1/1993 | Campion | 123/446 |

*Primary Examiner*—Willis R. Wolfe
*Assistant Examiner*—Thomas N. Moulis
*Attorney, Agent, or Firm*—Sixbey, Friedman, Leedom & Ferguson

[57] ABSTRACT

A fuel system for fuel injectors of an internal combustion engine is provided with a hydromechanical timing valve having a valve body assembly with a barrel and plunger arrangement. The plunger is displaceable within the barrel under the counterbalancing forces of rail fuel pressure (load) and one or more timing valve springs. The relative position of the barrel and plunger determines the effective size of the port through which timing fluid can flow. In accordance a first embodiment, the plunger has a tapered head which covers and uncovers ports in the barrel to a greater or lesser extent, thereby creating a variable flow-through cross section. Alternatively, in accordance with other embodiments, the barrel has ports with slot-like orifices of progressively changing widths which coact with a metering groove on the spool to define a variable flow cross section through which the timing fluid must pass. Optionally, for highway motor vehicle applications, to increase fuel economy, a delayed timing advance feature can be incorporated into the timing valve. More specifically, by a controlled leakage effect, the valve plunger can be caused to shift in a direction causing timing to be advanced (timing fluid supply increased) only after a predetermined period of time has elapsed. This delayed timing advance can be produced, in accordance with the invention, via a second, internal plunger, or via a second, diaphragm-operated external plunger.

21 Claims, 9 Drawing Sheets

INFINITELY VARIABLE HYDROMECHANICAL TIMING CONTROL

BACKGROUND OF THE INVENTION

1. Field of the Invention

The present invention relates generally to controls for fuel injection systems for internal combustion engines. More specifically, the invention relates to a control for regulating injection timing in fuel injectors for compression ignition type internal combustion engines, wherein fuel is supplied to unit fuel injectors which operate on a pressure-time metering principle.

2. Background Art

Unit fuel injectors which operate on a pressure-time metering principle have been in use for some time now (see U.S. Pat. Nos. 4,721,247; 4,986,472 and the patents mentioned therein), and have contributed greatly to the ability of internal combustion engine designers to meet the ever increasing demands for improved pollution control and increased fuel economy. In fuel supply systems using such injectors, fuel is supplied by a gear pump to all of the injectors via a common fuel rail and the same is true for timing fluid used to control the degree that the timing of the injection event is advanced or retarded, with the quantity of fuel and timing fluid delivered to each injector being a function of the supply pressure from the common rail and the time period during which the metering and timing chambers are in communication with the respective supply rails. Examples of gear pump type fuel supply systems for P-T type unit fuel injectors can be found in U.S. Pat. Nos. 4,909,219 and 5,042,445.

However, for the continuing demands for improved pollution control and increased fuel economy to be met, it becomes increasingly essential to be able to optimize the combustion process, not only by precisely controlling the quantity of fuel injected into each cylinder, but also by precisely regulating the timing thereof, and this has become increasingly more difficult as the level of combustion efficiency to be obtained is raised. Ultimately, increased precision means that the controller must be infinitely variable as well as responsive to the various parameters affecting fuel quantity and timing. Furthermore, since the governmental demands for emissions are less stringent for engine operation under steady-state (cruise) conditions than they are for transient (city/acceleration) conditions, increased fuel economy is obtainable if the controller can distinguish between transient and steady state operating conditions, and modify the engine timing accordingly. Ideally, such a controller would not require significant redesign of existing systems, so that it could be retrofit installed on them, not merely incorporated into new units.

U.S. Pat. No. 4,869,219 discloses an air fuel control for P-T fuel systems which uses a diaphragm-type operator to provide a controlled, optimum amount of fuel as a function of intake manifold pressure, and which can be retrofit installed on previously existing engines. However, no equivalent control for regulating engine timing is provided, nor is any delay function provided for enabling a modified effect to be produced once steady-state operation has been achieved.

U.S. Pat. Nos. 3,486,492 and 4,408,591 show fuel injection pumps which have a built-in timing control which can delay advancing of injection timing upon acceleration. However, these disclosures relate to distributor-type pumps not gear pumps, and are not adapted to the needs of P-T fuel injectors and the fuel systems therefor.

SUMMARY OF THE INVENTION

In view of the foregoing, it is a general object of the present invention to provide an infinitely variable hydromechanical timing valve that can precisely regulate engine timing as a function of engine speed and load conditions.

It is a more specific object of the present invention to provide a hydromechanical timing valve which can be retrofit installed on existing fuel injection systems with little or no modification to existing hardware.

Another object of the invention is to provide a hydromechanical timing valve which can distinguish between transient and steady state operating conditions, and modify the engine timing accordingly.

A more specific object of the invention is to provide spool valve type controller that provides a truly infinite injection timing adjustment capability in a manner which possesses a high degree of flexibility with respect to the timing curve producible.

These and other objects are achieved in accordance with preferred embodiments of the present invention in which a spool-type hydromechanical timing valve is provided with a valve body assembly having a barrel and plunger arrangement. The plunger is displaceable within the barrel under the counterbalancing forces of rail fuel pressure (load) and one or more timing valve springs. The relative position of the barrel and plunger determines the effective size of the port through which timing fluid can flow. For example, in accordance a first embodiment, the plunger has a tapered head which covers and uncovers ports in the barrel to a greater or lesser extent, thereby creating a variable flow-through cross section. Alternatively, in accordance with other embodiments, the barrel has ports with slot-like orifices of progressively changing widths which coact with a metering groove on the plunger to define a variable flow cross section through which the timing fluid must pass.

In addition, for highway motor vehicle applications, increased fuel economy can be achieved by incorporation of a delayed timing advance feature into the timing valve. More specifically, by a controlled leakage effect, the valve plunger can be caused to shift in a direction causing timing to be advanced (timing fluid supply increased) only after a predetermined period of time has elapsed. This delayed timing advance can be produced, in accordance with the invention, via a second, internal plunger, or via a second, diaphragm-operated external plunger. Alternatively, this feature can be achieved via a separate electronic controller, or e.g., for marine applications, this delayed advance feature may be omitted.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

In the drawings, throughout the various embodiments like numerals are use to identify like elements which have remained unchanged from one embodiment to another with a prime (') designation being used to indicate when a corresponding element has been modified from one embodiment to another.

DETAILED DESCRIPTION OF THE PREFERRED EMBODIMENTS

Figure 1:
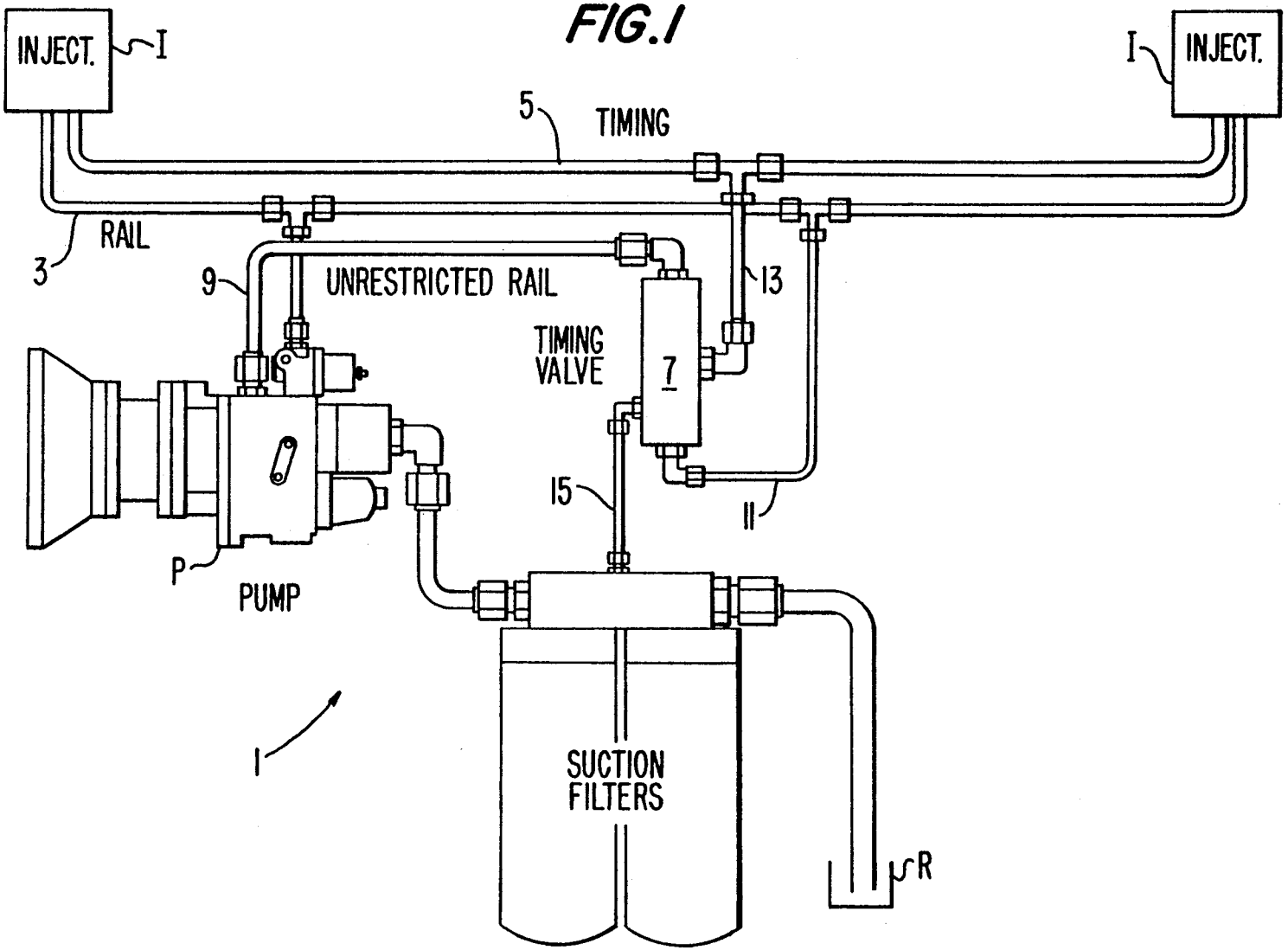
FIG. 1 a fuel supply system incorporating a timing valve.

FIG. 1 depicts the basic constituents of a fuel supply system 1 for supplying fuel and timing fluid to the injectors I of an internal combustion engine (not shown). This system 1 utilizes a convention supply pump P to supply fuel from a fuel reservoir R to all of the injectors I at a pressure that is controlled in accordance with engine operating conditions (in a known manner) via a common fuel supply rail 3, and to supply timing fluid to all of the injectors via a common second supply rail 5. In order to make the supply of timing fluid speed and load responsive, a timing valve 7 is to receive fuel at the unrestricted rail pressure of the supply pump P (which is engine speed responsive) via a pump pressure rail 9 and is exposed to fuel at the fuel supply pressure of rail 3 (which is engine load responsive) via a fuel pressure line 11. Timing fluid, as regulated by timing valve 7, is supplied to timing rail 5 via a connector line 13 and leakage is drained from timing valve 7 via a drain line 15.

In all embodiments of the present invention, the timing valve 7 is an infinitely variable hydromechanical timing valve. In a first form of timing valve 7 shown in FIG. 2, a valve barrel 18, having an axial bore 20, is fixed within a valve housing 22, and valve barrel 18 is sealed relative to the housing 22 by a plurality of annular seals 24. A timing valve plunger 26 is mounted for reciprocation within the axial bore 20 of the valve barrel 18. At least one timing spring 28 is disposed in the valve housing 22 so as to act on a first end of the timing valve plunger 26 and an opposite, second end of the timing valve plunger is in communication with the fuel supply rail 3 by fuel pressure line 11 being connected to axial bore 20 via a fuel pressure inlet 22*a* of housing 22. Additionally, the pump unrestricted rail pressure 9 connects the supply pump P directly to a timing fluid inlet 22*b* of housing 22, and the timing fluid supply rail 5 is connected by the connector line 13 to a timing fluid outlet 22*c* of the housing 22.

A distribution annulus 30 is formed between the valve barrel 18 and the valve housing 22, and this distribution annulus 30 allows timing fluid from the timing fluid inlet 22*b* to reach the axial bore 20 via a plurality of circumferentially spaced timing fluid inlet ports 18*a* that are formed in the barrel 18 at a first location along the length of the axial bore 20. Similarly, a collection annulus 32 receives timing fluid exiting the axial bore 20 via a plurality of circumferentially spaced timing fluid outlet ports 18*b* that are formed in the valve barrel 18, at a second location that is axially spaced along the length of the axial bore 20 relative to the timing fluid inlet ports 18*a*, and communicates the exiting timing fluid with the timing fluid outlet 22*c* of the valve housing 22, allows it to flow to the timing fluid supply rail 5 via connector line 13.

Figure 2:
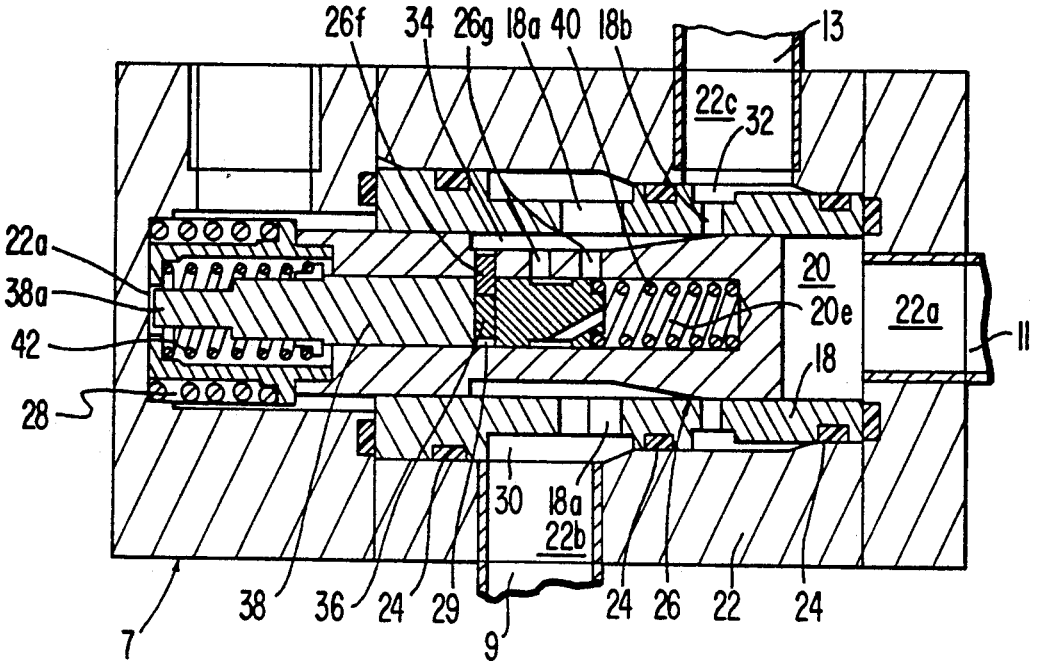
FIG. 2 shows a first embodiment of a timing valve in accordance with the present invention.
Figure 2A:
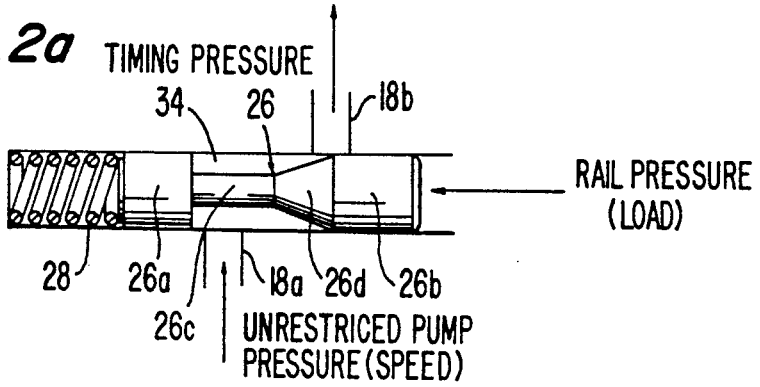
FIG. 2*a* a schematic diagram of the timing plunger of the FIG. 2 embodiment for illustrating the manner in which it coacts with a metering port to for a variable orifice.

As shown in FIG. 2, but is more clearly apparent from the schematic of FIG. 2*a*, valve plunger 26 has a first end portion 26*a* that is acted upon by the spring 28 and a second end portion that is acted upon by the fuel supply rail pressure. These end portions 26*a*, 26*b*, are machined to sufficiently closely match the diameter of axial bore 20 so as to prevent leakage of the fuel into the timing fluid path, under the action of rail pressure, without inhibiting free sliding of the valve plunger 26 within the valve barrel 18. Between the end portions 26*a*, 26*b*, the valve plunger has a stem 26*c*, which forms a metering annulus 34 relative to the inner wall of the valve barrel 18 into which timing fluid flows from timing fluid inlet ports 18*a*, and an orificing portion 26*d* having a tapered circumferential wall. The tapered orificing portion 26*d* of the timing valve plunger 26 and the timing fluid outlet ports 18*b* coact to form a variable orifice means for varying the flow-through cross section through which timing fluid must travel from the timing fluid inlet 22*b* to the timing fluid outlet 22*c* as a function of movement of said timing valve plunger 26 within the axial bore 20. That is, with the tapered shape shown, the more that the timing valve plunger 26 moves rightward from its minimum flow position shown in FIG. 2, the greater is the cross section of the gap between the orificing portion 26*d* and the outlet port 18*b* and the more of area of outlet port 18*b* is no longer blocked by the timing plunger end portion 26*b*.

As represented, increases in fuel supply rail pressure (which reflect engine speed and load) will cause the timing valve plunger 26 to move in a direction decreasing timing fuel flow (retarding timing) to the extent that the fuel supply rail pressure exceeds the opposing force of the timing spring 28. Thus, the position of the timing valve plunger 26 in the axial bore of the valve barrel, and therefore, the flow-through cross section of the variable orifice means, is a function of rail pressure in said fuel supply rail, and the spring rate and spring preload of timing spring 28. As a result, by controlling the spring rate and preload as well as the specific contour of the orificing portion 26*d* (the contour need not be a continuous taper, nor is it required that the contour change in a direction of decreasing timing plunger diameter), the relationship between the flow-through cross section and the fuel supply rail pressure can be adjusted as needed to provide a desired injection timing curve. In this regard, it is noted that, to keep the same start of injection at the same engine speed, the engine requires less timing fuel flow for a high rail flow rate and more timing fuel flow for a low rail flow rate.

As mentioned in the Background portion of this specification, governmental emissions requirements are less stringent under steady-state highway or cruise conditions than under transient city or acceleration conditions so that the opportunity exists to permissibly vary engine combustion parameters to increase fuel economy, such as by advancing the engine timing. To this end, the FIG. 2 embodiment incorporates a feature by which timing valve plunger 26 is caused to increase the flow-through cross section, after a predetermined period of time has elapsed, and thus, gradually advances engine timing so long as a particular engine load and engine speed is maintained.

More specifically, first and inner plungers 36, 38 are mounted for reciprocation within a cavity 20*e* of the timing plunger 26, these inner plungers 36, 38 being spring-loaded toward each other, by springs 40, 42, into a neutral position (shown in FIG. 2). In this position one end of the first inner plunger 36 faces an inner end portion of the inner cavity 20*e*, and an opposite end 38*a* of the second inner plunger 38 is positioned at a predetermined distance from an inner plunger stop formed by a wall portion 22*d* of the valve housing 22. In said neutral position, both plungers 36 and 38 rest against pins 26F (only one of which is shown) which project from the inner wall of plunger 26 and create a gap 29 between plungers 36 and 38. A controlled leakage path is provided for leaking a portion of timing fluid flowing from said timing fluid inlet port 18*a* to the timing fluid outlet port 18*b* into a cavity area between the first and second inner plungers 36, 38. This leakage path is formed by the radial clearance between plungers 26 and 36.

The leakage rate through the radial clearance and the distance of the plunger end 38*a* from the stop-forming housing wall portion 22*d* is such that timing fluid will leak into the cavity area between plungers 36 and 38 and with the appropriate delay displace the second inner plunger 38 into engagement with housing wall portion 22*d* and then act upon the timing valve plunger 26 thru plunger 36 which is held in place by unrestricted rail pressure in cavity 20*e* to the right of plunger 36. This urges plunger 26 to the right, thereby gradually increasing the timing fluid flow and bringing about an advance in engine timing. The rate of advance is a function of the diameter of the inner plunger 38, the larger the diameter the slower the rate of advance since the volume that is displaced in the cavity between plungers 36 and 38 is greater per unit of displacement. Since, during this timing adjustment phase, unrestricted rail pressure is acting on the right side of the first inner plunger 36 and the force of spring 40 is acting on its inner end in addition to the said unrestricted rail pressure, which enters via resetting ports 26*g*, the first inner plunger 36 does not move due to compression of spring 40.

On the other hand, movement of timing valve plunger 26 in a direction restricting timing flow (due to increased fuel supply rail pressure) is not delayed. That is, drain means is provided for draining timing fluid from the cavity area between the inner plungers 36, 38 so that it does not inhibit movement in a timing retarding direction (to the left in FIG. 2). More specifically, whenever the pressure in the cavity area between the inner plungers 36 and 38 exceeds unrestricted rail pressure, inner plunger 36 compresses its spring 40, fuel at the inner side of plunger 36 flows freely out of resetting ports 26*g*, and the reduced diameter end of the inner plunger 36 uncovers the first of the resetting ports 26*g*, quickly bleeding-out the pressure in the cavity area between the inner plungers 36, 38 to the lower unrestricted rail pressure.

Figure 3:
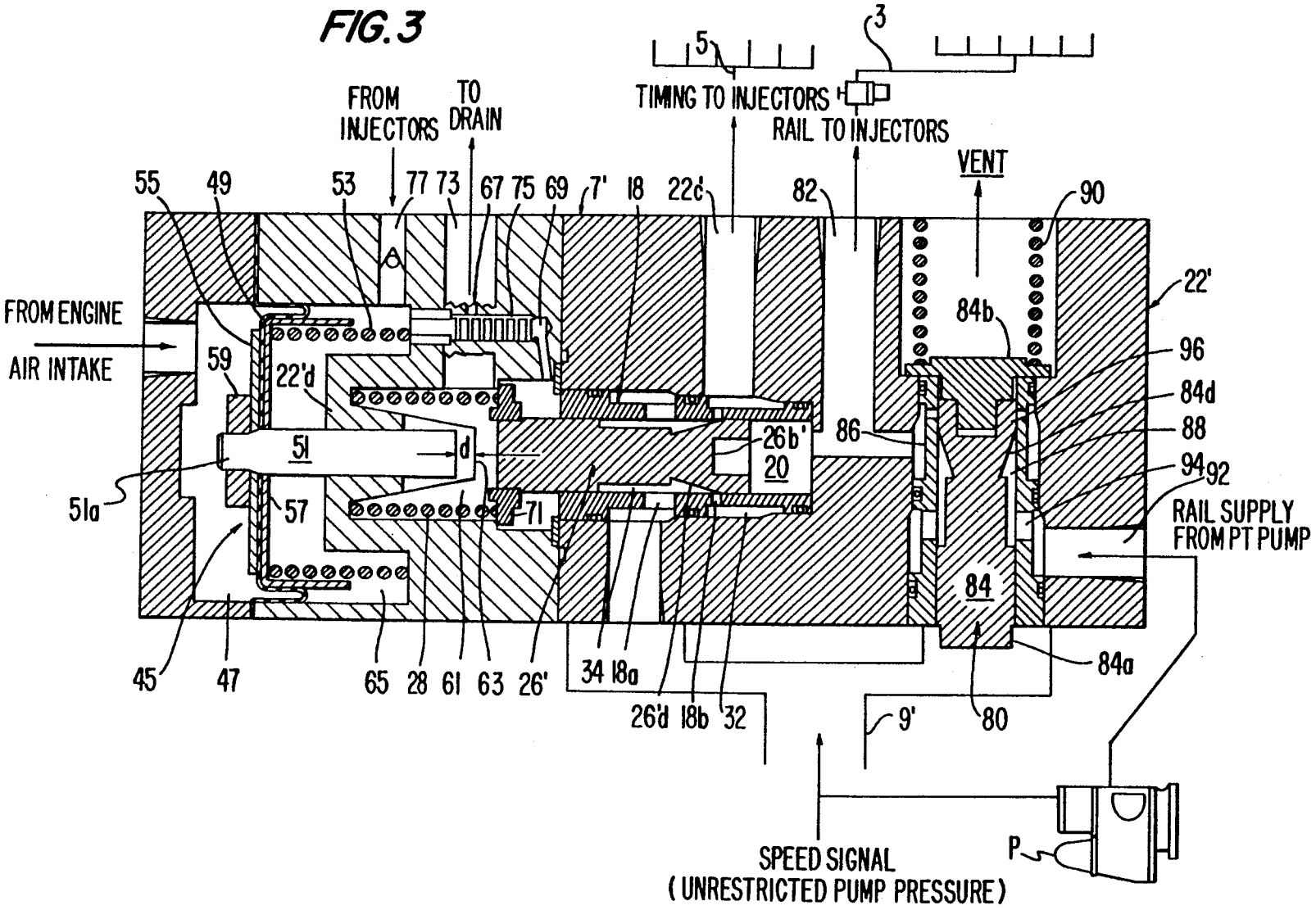
FIG. 3 schematically shows a fuel injection system utilizing a second embodiment in accordance with the present invention.

An alternative manner of achieving a delayed gradual timing advance is shown in connection with the timing valve 7′ of FIG. 3. In this case, a delayed timing adjustment action is produced by connecting the engine air intake manifold to a diaphragm type valve operator 45, one side of which is acted upon by the engine air intake pressure that is communicated into an air intake pressure chamber 47, and an opposite side of which is positioned to act together with the timing spring 28 on the second end of the timing valve plunger 26′ so as to move the left end of the timing spring 28 after a predetermined time interval.

The diaphragm type valve operator 45 comprises a diaphragm membrane 49, to which an actuating plunger 51 is attached at a side facing the timing valve plunger 26′, and a delay spring 53 for biasing the diaphragm in a direction acting to collapse the air intake pressure chamber 47. A central portion of the diaphragm membrane 49 is sandwiched between a backing plate 55 and a delay spring keeper 57. A reduced diameter, threaded end 51*a* of the actuating plunger 51 is passed through the delay spring keeper 57, the diaphragm membrane 49 and then the backing plate 55, after which it is secured by a retaining nut 59, that clamps the backing plate 55 and delay spring keeper 57 together. The opposite end of the actuating plunger 51 is slidingly guided through a wall 22′d of the timing valve 7′ housing into timing spring chamber 61. In an initial position of the plunger 51, a predetermined distance d exists between the end of the actuating plunger 51 located in timing spring chamber 61 and a facing surface of a cup-shaped timing spring keeper 63 for the timing spring 28.

Figure 8:
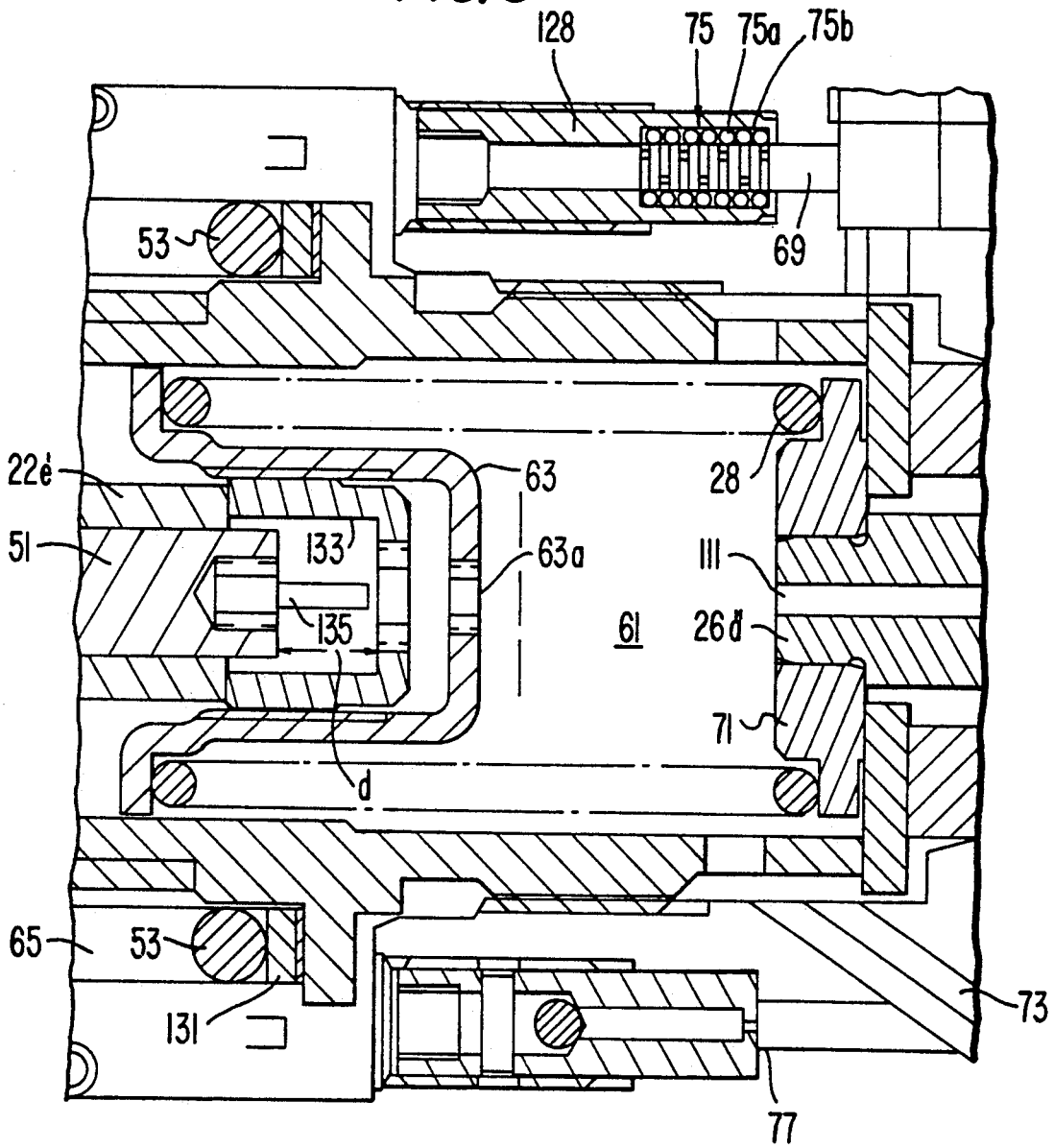
FIG. 8 shows an enlarged detail of FIG. 7.

The delay spring 53 is located in a fluid-filled delay chamber 65. A drain orifice means 67 sets a controlled rate at which fluid may drain from the fluid-filled delay chamber 65 in response to pressing of the diaphragm membrane 49 thereagainst under sustained action of engine air intake pressure. Drain orifice means 67 comprises a drain passage 69 interconnecting delay chamber 65 with timing spring chamber 61 (plunger-mounted spring keeper 71 does not block flow through timing spring chamber 61 from drain passage 69 to drain outlet 73), and a flow-restricting orifice element 75 disposed therein. The flow-restricting orifice element 75, as shown in FIG. 8 can be a labyrinthine arrangement of orifices and spacers, as is described in greater detail below, and opens into the top area of delay chamber 65 to allow air to be expelled from behind the actuating piston 51 in the delay chamber. The fluid-filled chamber 65 is connected to a source of fluid, such as fuel from fuel pump P, in a manner enabling refilling of chamber 65 when the diaphragm membrane 49 is returned toward its initial position by the delay spring 53.

The timing spring 28 has an end which faces away from timing valve plunger 26′ (toward the left in FIG. 3), and which is supported on the cup-shaped timing spring keeper 63. Whenever the engine air intake pressure is above a predetermined value for a predetermined time, a cruise or highway condition is considered to exist. The predetermined pressure value is set by the delay spring 53, and the predetermined time is set by time that it takes sufficient fluid to pass through the drain orifice means 67 to enable the free end of the actuating plunger 51 to travel the predetermined distance d with diaphragm membrane 49 so as to engage and displace the timing spring keeper 63. After actuating plunger 51 engages the timing spring keeper 63, it will gradually act to shift the timing valve plunger 26' back against the force of the fuel supply rail pressure, thereby producing a gradual timing advance, at a rate dictated by the rate at which timing fluid is able to pass out of the delay chamber 65 via the drain orifice means 67. If the vehicle gets out of the steady state cruise mode, the engine air intake pressure will drop and the delay spring 53 will cause the actuating plunger 51 to retract and the diaphragm membrane 49 to draw fluid (fuel) back into the delay chamber 65 at a controlled rate via the drain orifice means 67 and a check valve controlled line 77 that is connected to receive fuel from the drain flow from the fuel injectors.

As also shown in FIG. 3, the timing valve 7' can be located in a common housing 22' with an engine torque curve shaping fuel pressure regulator 80 for controlling the pressure of fuel supplied to the fuel injectors by the first supply rail 3 via an outlet passage 82 of the pressure regulator 80. The outlet passage 82 of the pressure regulator 80 is also connected to axial bore 20 for communicating the fuel supply pressure with the second end **26'*b* of the timing valve plunger 26'**.

Preferably, the pressure regulator 80 is constructed in the same manner as the timing valve 7, and thus, comprises a second variable orifice means for controlling the pressure of fuel in the first supply rail 3 as a function of unrestricted rail pressure. To this end, pump pressure rail 9 has a branch which exposes the end **84*a* of regulator valve plunger 84 to the engine speed related unrestricted rail pressure of the pump P. Furthermore, like timing valve 7, the pressure regulator 80 comprises a second valve barrel 86 having a second axial bore 88 within which the regulator valve plunger 84 is mounted for reciprocation, and a regulator spring 90 which acts on a the end 84*b* of the regulator valve plunger 84. A governed rail pressure outlet of the pump P is connected to a rail supply fuel inlet 92 of housing 22' and to axial bore 88 via a fuel inlet port 94 in the valve barrel 86 that is axially spaced along the length of the axial bore 88 relative to the location of fuel outlet ports 96 formed in barrel 86. As was the case for timing valve plunger 26', the regulator valve plunger 84 and the fuel outlet ports 96 coact to form a variable orifice for varying the flow-through cross section for fuel traveling from the rail supply fuel inlet port 94 to the fuel outlet passage 82 as a function of the position of the regulator plunger 84, and in particular its tapered orificing portion 84*d* in the second axial bore 88, and thereby making the flow-through cross section of the second variable orifice means a function of unrestricted rail pressure, and of the spring rate and spring preload of the regulator spring 90**.

In the embodiments described so far, a variable orifice means has been formed using a varying contour of a timing plunger portion in conjunction with a conventionally shaped outlet port. However, a preferred alternative approach will now be described in which a metering port in the barrel has an axially extending length and a width that varies along its length, and the timing plunger has an annular metering groove on a peripheral surface of said plunger, the metering groove having a width that is substantially smaller than the length of said metering port, whereby the variable flow-through cross section is defined by the area of overlap between a portion of the length of the metering port and the metering groove. More specifically, with reference to FIGS. 4 & 5, a first such embodiment will be described.

In timing valve 7'', passage means 101 is provided in the timing plunger 26'' (e.g., in the form of eight small holes, only two of which are shown) for communicating the timing fluid inlet ports **18''*a* with a metering groove 103 that is formed circumferentially about the timing plunger 26''. Additionally, four equally sized keyhole-shaped metering ports 105 are formed in the valve barrel 18''. The flow-through cross section is determined by the position of the timing plunger 26'' in that the shape of the metering ports 105 is fixed as is the size of the metering groove 103 so that the outlet port cross section is determined by the portion of the metering ports 105 that is overlapped by the metering groove 103, and changes, in accordance with the axial changes in width of the metering ports 105, as the metering groove 103 is axially displaced with the timing plunger 26'' along their length (see FIG. 6**).

To prevent leakage of fuel from the fuel rail through the metering ports 105, a circumferential collection groove 109 is formed on the periphery of timing plunger portion **26''*b* between the metering groove 103 and the free end thereof upon which the rail pressure force acts. Fuel collected in groove 109 drains therefrom, into a central drain passage 111, via a plurality of radial drain passages 113, and exits drain passage 111, at end portion 26''*a*, into the timing spring chamber 61', from which it returns to the fuel reservoir R via drain line 73'**.

As will be appreciated, based upon experimental data, different shapes and sizes for the metering ports can be arrived at, and the spring rating can be chosen according to calculations made from the experimental data obtained. Additionally, a timing spring adjustment bolt 107 or the like can be used to appropriately adjust the preload force on the timing spring 28. One example of an alternative metering port configuration which has been found to be effective is shown in FIG. 6. In this case, a triangularly-shaped metering port shape is used to obtain a progressive change in the flow-through cross section of the port formed by the coaction of the metering groove 103 with the metering ports 105'. Otherwise, the nature and operation of the embodiments of FIGS. 4–6 are essentially the same as that for preceding embodiments, and it should be appreciated that these same modifications could be applied to the fuel pressure regulator 80 as well.

Figure 4:
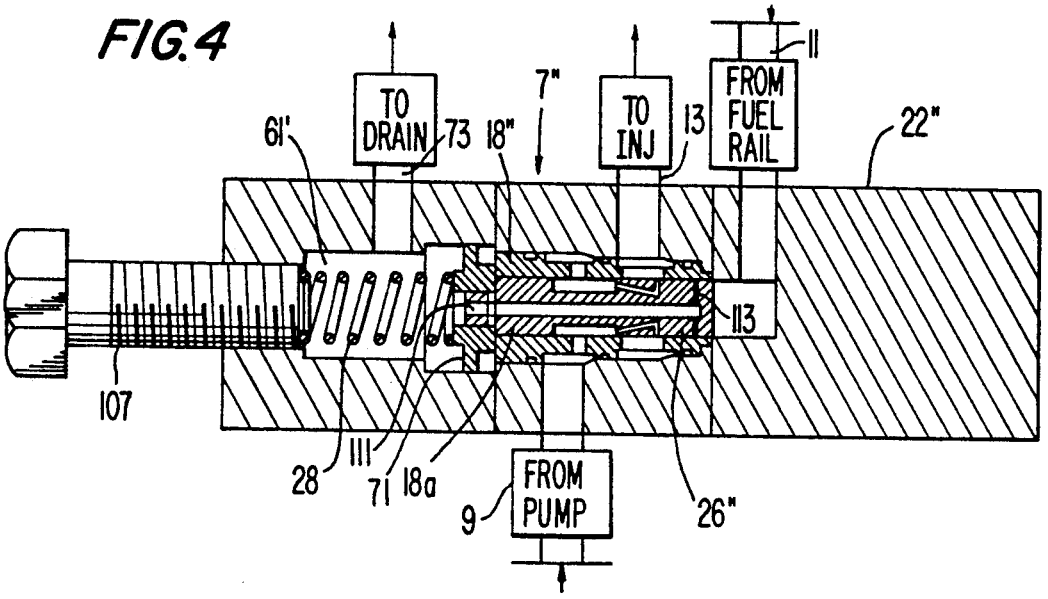
FIG. 4 illustrates another embodiment of a timing valve in accordance with the present invention.
Figure 5:
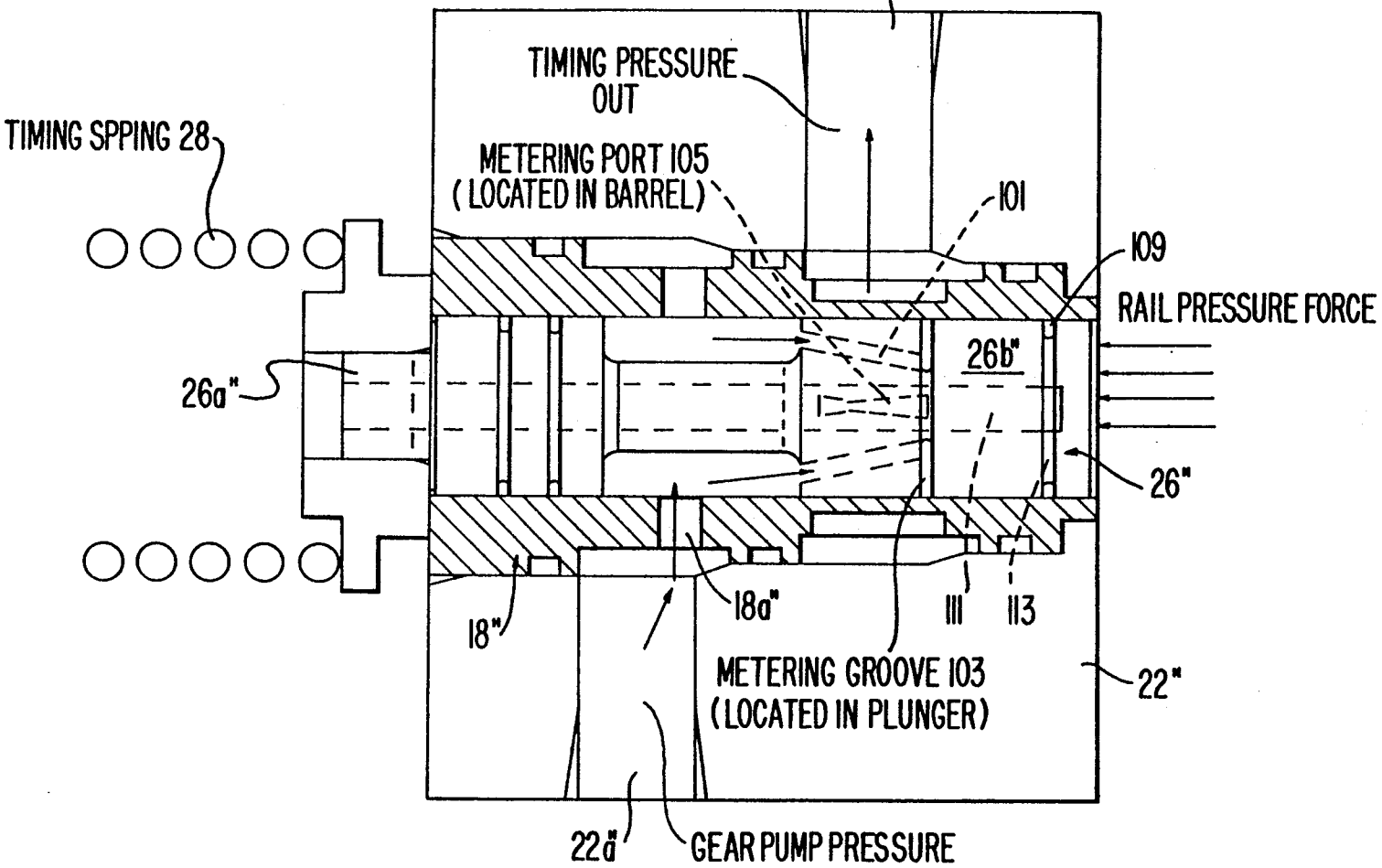
FIG. 5 is an enlarged detail of the valve plunger and barrel port area of the FIG. 4 timing valve.
Figure 6:
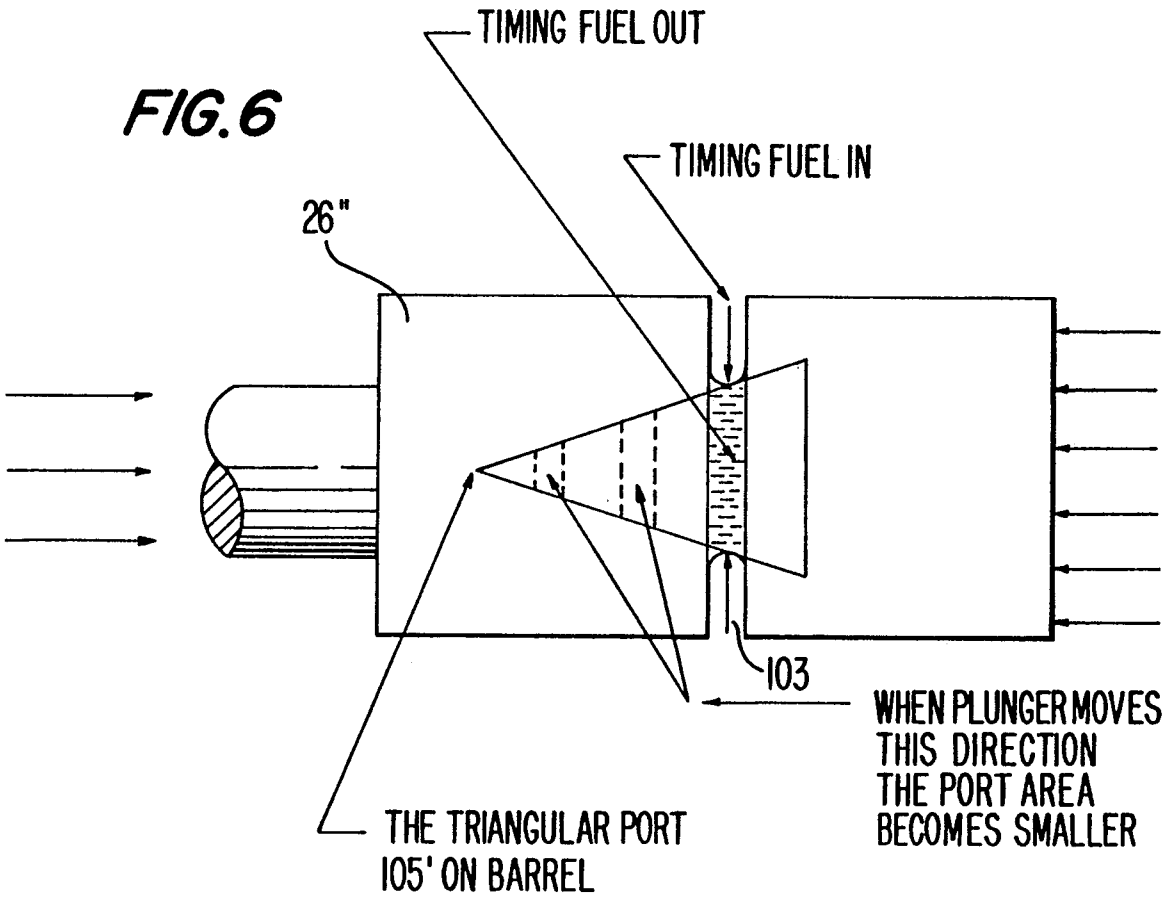
FIG. 6 is an enlarged diagrammatic showing a modified barrel port configuration for the FIG. 4 timing valve.
Figure 7:
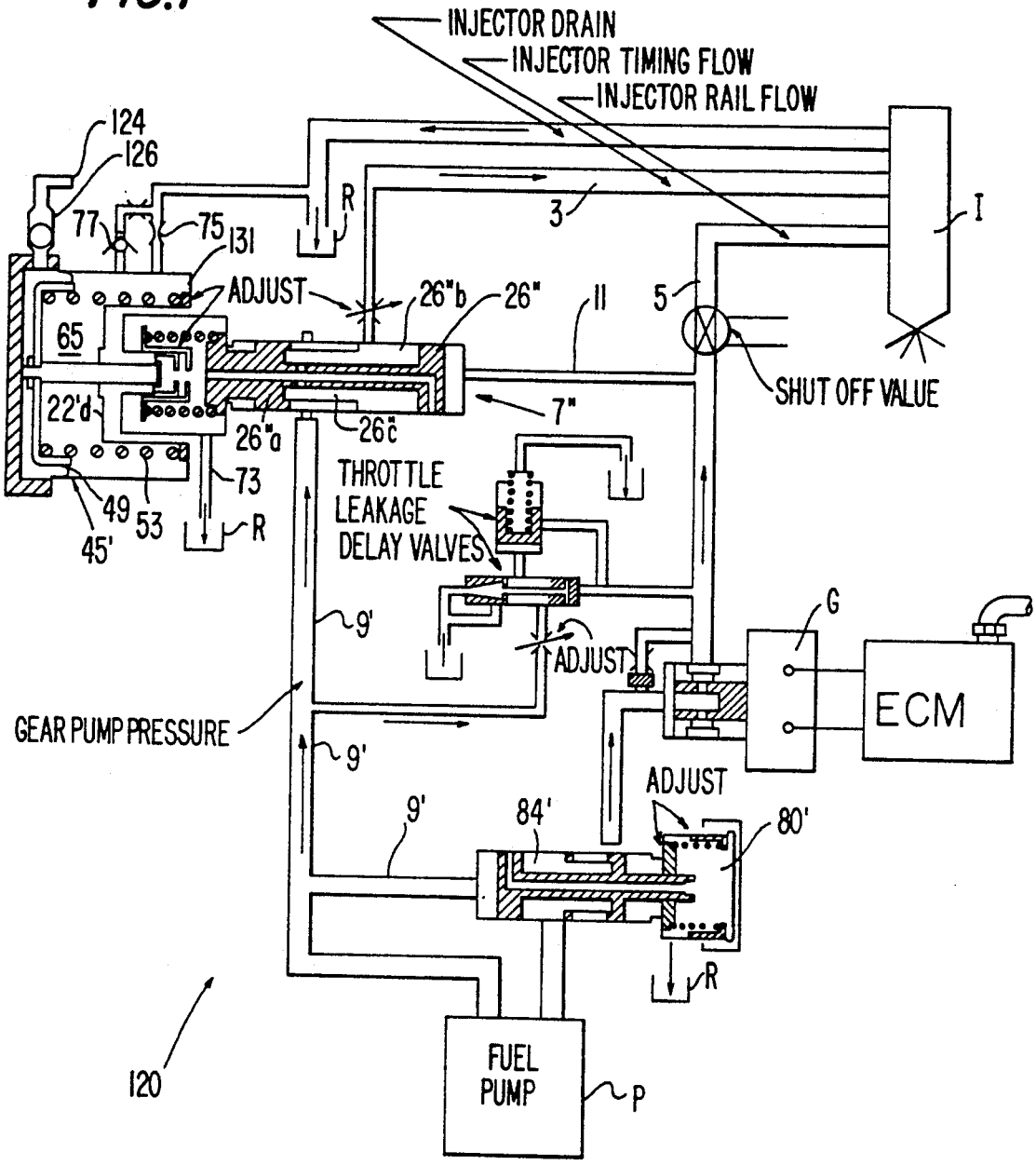
FIG. 7 is a schematic depiction of a fuel supply system incorporating a timing valve of the types shown in FIGS. 4–6 with a delayed timing advance arrangement of the type shown in FIG. 3.

Furthermore, a delayed action, diaphragm-type valve operator, like that shown for the embodiment of FIG. 3, can be used with the embodiments of FIGS. 4–6, as can be seen with reference to FIGS. 7 & 8, in which a fuel supply system 120 is schematically depicted that has a timing valve of the types shown in FIGS. 4–6 incorporated into a modified valve unit using a delayed timing advance arrangement of the type shown in FIG. 3. In describing fuel supply system 120, only those aspects which differ from or have not been described with respect to the previous embodiments will be commented upon. Furthermore, since the details of the controlling of fuel flow to the injectors I form no part of this invention beyond the use of a variable orifice construction for the fuel regulator 80' that corresponds to that of the timing valves of this invention, a full explanation thereof, including operation of the electronic control module (ECM), governor G, throttle leakage delay valves, etc. has been omitted. Also, for simplicity, the valve barrel 18" has been omitted and only part of portions 26"*b* and 26"*c* of timing plunger 26" of timing valve 7" are shown in section (and the same is true for regulator plunger 84'); however, these unillustrated features are as described above.

Firstly, it can be seen from FIG. 7, that it is possible for the cooperative action between the timing valve and fuel regulator to be achieved without both being incorporated into a common housing. That is, a separate fuel regulator 80' may be used with timing valve 7". Furthermore, the air pressure line 124, linking the engine air intake manifold with the pressure chamber 47 of the valve operator 45, is, advantageously, provided with an air/fuel safety valve 126 to protect against fuel being drawn into the air line should the diaphragm membrane 49 rupture.

With reference to FIG. 8, details of the valve operator 45 can be seen. Firstly, it is an important aspect of the flow-restricting orifice element 75 is that it utilized a labyrinthine array of a plurality of orifice holes 75*a* instead of a single orifice hole. If a single orifice hole were used, it would have to be of a size that would be so small that it could plug. To avoid this problem, multiple orifices in series are used. For example, by using seven staggered orifice holes 75*a* separated by spacers 75*b*, each orifice can be increased so as to have a diameter that is approximately 0.020". Such an orifice element can be made of a metal stamping containing the seven orifice holes 75*a* and spacers 75*b* which is folded accordion style and inserted into a socket cartridge 128.

In order to be able to adjust the preload on the delay spring 53, one or more shims 131 can be inserted into the delay chamber 65, between the end of the delay spring 53 and the chamber end wall. Likewise, the preload on the timing spring 28 can be made adjustable by an adjustable keeper stop 133. Keeper stop 133 is threaded into the cup-shaped timing spring keeper 63 and is itself cup-shaped having a rim which, under the action of spring 28, engages on the end of a projection 22'*e* of the delay chamber wall 22'*d* that extends into the timing spring chamber 61. Thus, by threading the keeper stop 133 more or less into the timing spring keeper 63, the spring preload can be adjusted by changing the initial degree to which timing spring 28 is compressed. In this case, the distance d that the actuating plunger must travel before the timing plunger is shifted back against the fuel rail supply pressure force is set by the keeper stop 133 and remains constant despite changes in the relative position of the timing spring keeper 63 relative to the keeper stop 133. Additionally, a guide pin member 135 can be threaded into the end of the actuating plunger; this guide pin member 135 passed through the keeper stop 133 into a guide hole 63*a* in the spring keeper to minimized shifting or canting of the timing spring keeper 63 (which is possible as a result of the actuating plunger having a much smaller diameter than the inner diameter of the keeper stop 133) when the actuating plunger 51 acts thereon.

Figure 9:
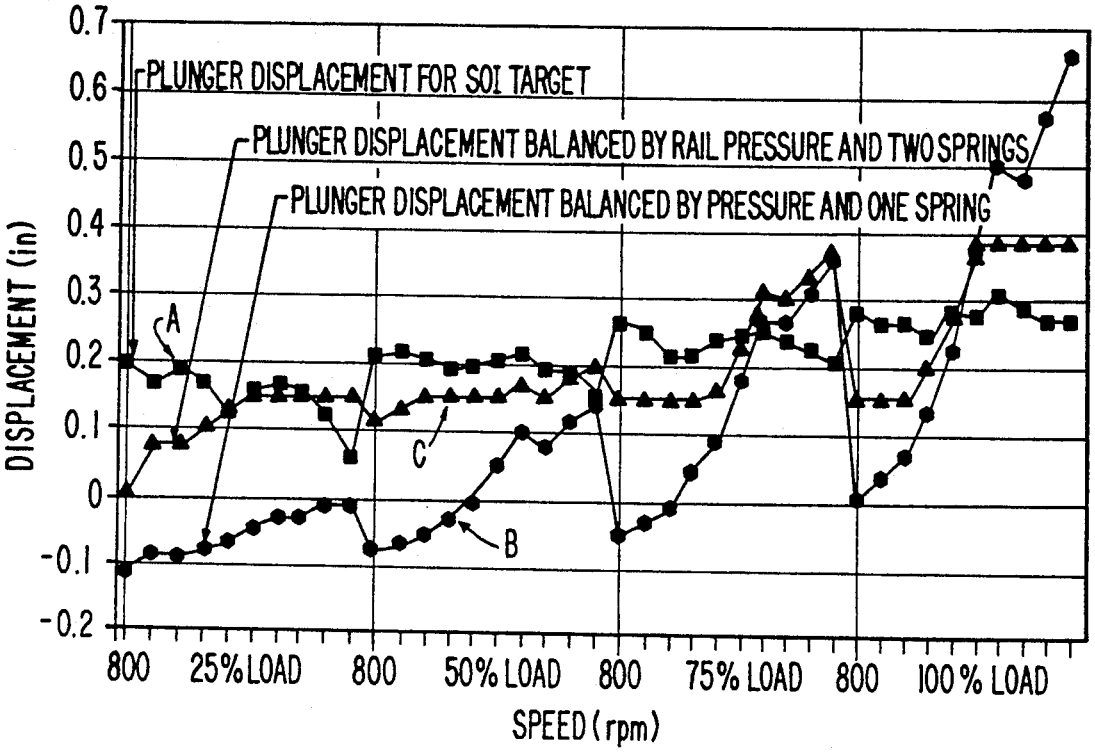
FIG. 9 is a graph comparing the performance of single spring and dual spring control arrangements for the timing plunger of the FIG. 4 embodiment.
Figure 10:
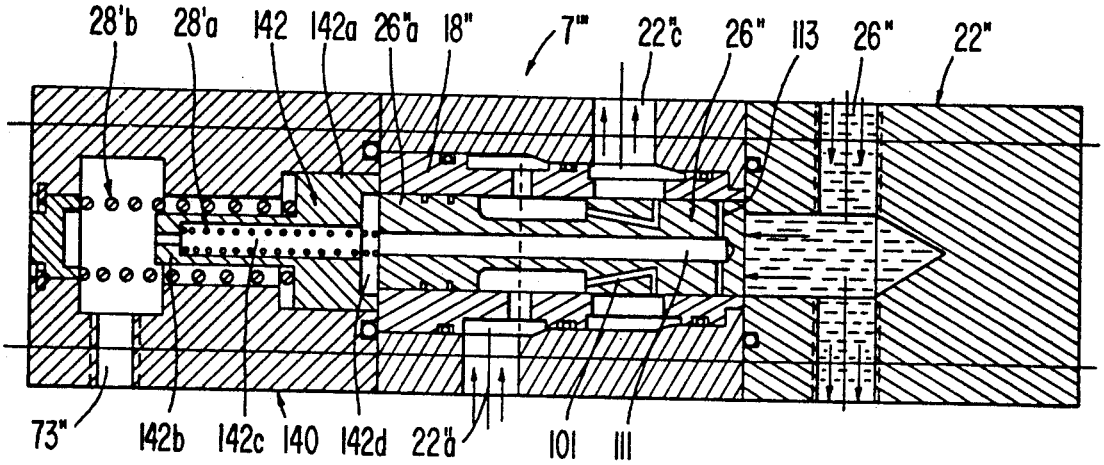
FIG. 10 shows a dual spring control arrangement for the timing plunger of the FIG. 4 timing valve.
Figure 11:
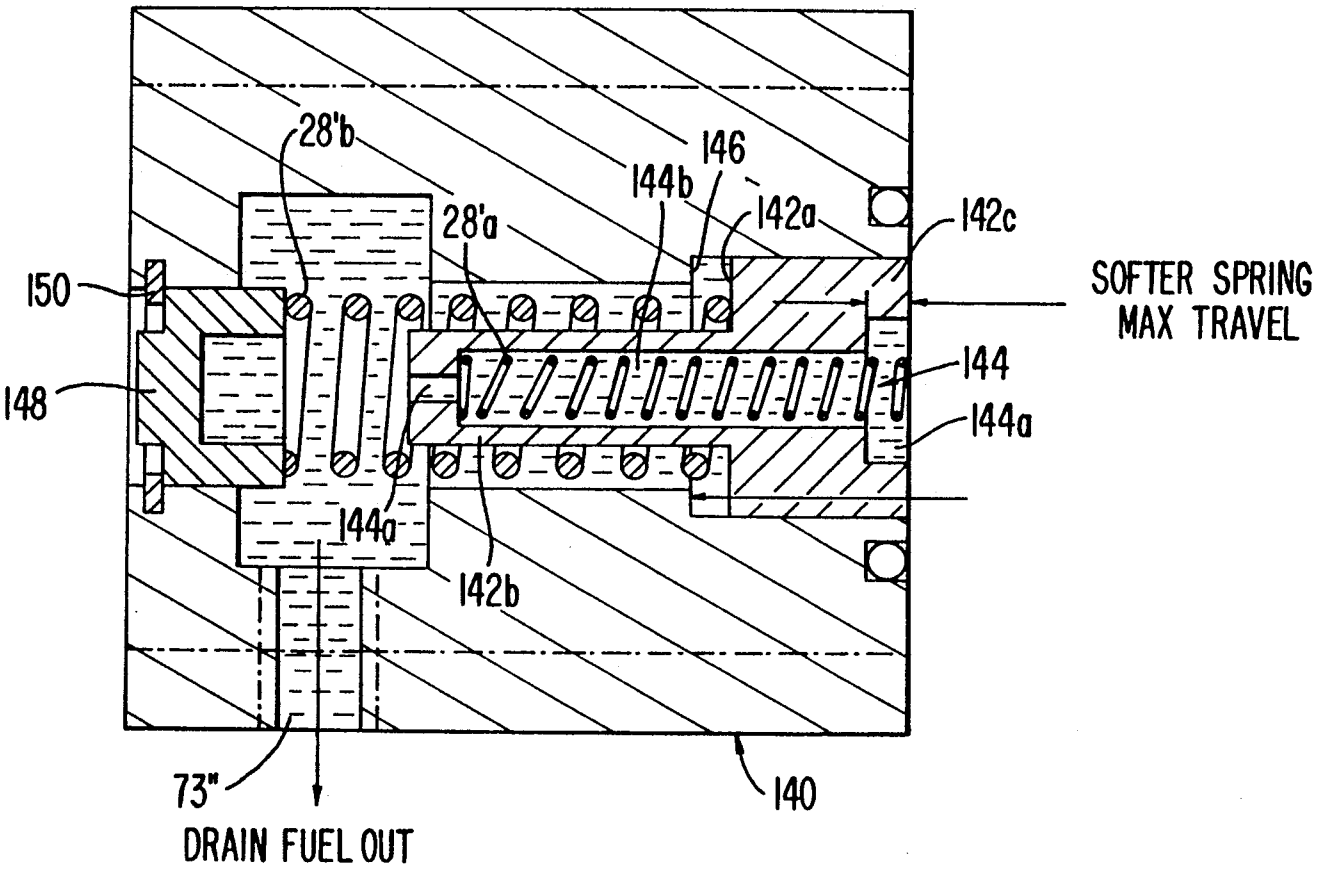
FIG. 11 is an enlarged view of the timing spring assembly of the FIG. 10 timing valve.

When rail fuel pressure will vary over a wide range of pressures (e.g., from 3 to 200 psi.) more than a single timing spring is desirable to balance the pressure variations at different engine loads. For example, with reference to FIG. 9, where the plunger displacements to achieve a target start of injection (SOI) is represented by curve A, as reflected by curve B, the target plunger displacements will not be achieved to a satisfactory extent by the balancing of rail pressure by one timing spring. On the other hand, as reflected by curve C, by the addition of a second spring, the target SOI can be closely approximated. A dual-spring timing valve 7"' is shown in FIG. 10 and differs from that of the embodiments of FIGS. 4–6 only with respect to the timing spring assembly 140, which is shown in enlarged scale in FIG. 11. Thus, only timing spring assembly 140 will be described in further detail.

Firstly, the pair of timing springs 28'*a* and 28'*b* have different spring rates, timing spring 28'*a* being soft and timing spring 28'*b* being stiff. The soft timing spring 28'*a* acts between the end 26"*b* of timing plunger 26"*a* and a combined spring keeper-travel stop 142. The spring keeper-travel stop 142 is a piston-shaped member having a head portion 142*a* and a rod portion 142*b* and a stepped central bore 144.

The smallest bore portion 144*a* merely provides a flow path to drain for leakage fuel which empties from central drain passage 111 of the timing plunger 26", and the middle bore portion forms a receptacle for the soft timing spring 28'*a*. The largest bore portion 144*a* is located adjacent end portion 26"*a* of timing plunger 26", and has a diameter that is larger than that of the timing plunger end portion 26"*a*, so as to permit it to telescope into it. The depth of bore portion 144*a* determines the maximum travel of the timing plunger 26" relative to soft timing spring 28'*a*. Similarly, the rear side of the head portion 142*a* of the spring keeper-stop limits travel of the timing plunger 26" relative to the stiff timing spring 28'*b* by engaging on a shoulder 146.

The stiff spring 28'*b* is held between the rear side of the head portion 142*a* of the spring keeper-stop 142 and a closure cap 148 that is held in place by a snap ring 150.

When the engine is run at light load and low speed, the rail fuel flow force will be only balanced by the soft spring 28'*a*, up to the time stop 142 no longer contacts 18" because spring 28'*b* starts to compress. Then, the rail fuel flow force will be balanced by both the soft and stiff springs until the limit of the distance the timing plunger can telescope into the large bore portion 144*a* is reached. When the engine is run at high load and high speed, the rail fuel flow force will be balanced by the stiff spring only up to the maximum travel limit imposed by shoulder 146.

It should be appreciated that this dual spring arrangement is not limited to the embodiments of FIGS. 4–7 and can be applied relative to any of the timing valve arrangement described above. Thus, while we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

INDUSTRIAL APPLICABILITY

The present invention will find applicability in a wide range of fuel injection systems for internal combustion engines, particularly diesel engines. The invention will be especially useful where precision timing is essential and/or it is desired to use a hydromechanic control system instead of an electronic one.

We claim:

1. In a fuel supply system for an internal combustion engine of the type wherein a supply pump supplies fuel to fuel injectors at a pressure that is controlled in accordance with engine operating conditions via a common first supply rail and supplies timing fluid to the fuel injectors via a common second supply rail, an infinitely variable hydromechanical timing valve comprising a valve barrel having an axial bore and a timing valve plunger mounted for reciprocation within the axial bore of the valve barrel, at least one timing spring acting on a first end of the timing valve plunger, and an opposite, second end of the timing valve plunger being in communication with the first supply rail; wherein an outlet of the supply pump is directly connected to a timing fluid inlet at a first location along the length of the axial bore and said second supply rail is connected to a timing fluid outlet at a second location that is axially spaced along the length of the axial bore relative to said first location; wherein said timing valve plunger and said timing fluid outlet coact to form a variable orifice means for varying a flow-through cross section for timing fluid traveling from said timing fluid inlet to said timing fluid outlet as a function of movement of said timing valve plunger toward and away from said first and second locations, whereby the position of the timing valve plunger in the axial bore of the valve barrel, and therefore, the flow-through cross section of the variable orifice means, is a function of rail pressure in said first supply rail, and spring rate and spring preload of said at least one timing spring.

2. In a fuel supply system for an internal combustion engine according to claim 1, wherein said variable orifice means comprises metering ports at an inner end of said timing fluid outlet and a tapered peripheral surface on said timing valve plunger, said variable flow-through cross section being defined by a radial gap between the metering ports and the tapered peripheral surface of said plunger.

3. In a fuel supply system for an internal combustion engine according to claim 1, wherein said variable orifice means comprises a plurality of metering ports at an inner end of the timing fluid outlet, said metering ports having an axially extending length and a width that varies along its length, and an annular metering groove on a peripheral surface of said plunger, said metering groove having a width that is substantially smaller than the length of said metering port; wherein the variable flow-through cross section is defined by an area of overlap between a portion of the length of said metering port and said metering groove; and wherein passage means is provided in said plunger for communicating said timing fluid inlet with said metering groove.

4. In a fuel supply system for an internal combustion engine according to claim 3, wherein said metering orifice is triangular in shape.

5. In a fuel supply system for an internal combustion engine according to claim 3, wherein said metering orifice has a keyhole-like shape.

6. In a fuel supply system for an internal combustion engine according to claim 3, wherein a plurality of timing springs of different spring rates act on said first end of the timing valve plunger.

7. In a fuel supply system for an internal combustion engine according to claim 1, wherein a plurality of timing springs of different spring rates act on said first end of the timing valve plunger.

8. In a fuel supply system for an internal combustion engine according to claim 1, further comprising delayed action means for increasing the flow-through cross section obtained for a given rail pressure after a predetermined time.

9. In a fuel supply system for an internal combustion engine according to claim 8, wherein said delayed action means comprises air intake means for connection to an engine air intake manifold, and force transfer means for adding engine air intake pressure to the force of said at least one timing spring after a predetermined time interval.

10. In a fuel system for an internal combustion engine according to claim 9, wherein said force transfer means comprises a diaphragm type valve operator, one side of which is acted upon by the engine air intake pressure and an opposite side of which is positioned to act on said second end of the timing valve plunger after a predetermined displacement of said diaphragm toward said timing valve plunger from an initial position thereof, and delay means for controlling the time required for said diaphragm to undergo said predetermined displacement.

11. In a fuel supply system for an internal combustion engine according to claim 10, wherein said diaphragm type valve operator comprises a diaphragm membrane to which an actuating plunger is attached at a side facing said timing valve plunger, and delay spring means for biasing said diaphragm toward said initial position thereof.

12. In a fuel supply system for an internal combustion engine according to claim 11, wherein said diaphragm membrane is disposed between an air intake pressure chamber and a fluid-filled chamber; and wherein said delay means comprises drain orifice means for setting a controlled rate at which fluid may drain from said fluid-filled chamber in response to pressing of said diaphragm membrane thereagainst under sustained action of said engine air intake pressure; and wherein said fluid-filled chamber is connected to a source of fluid in a manner enabling refilling of said chamber when said diaphragm membrane is returned toward its initial position by said delay spring means.

13. In a fuel supply system for an internal combustion engine according to claim 12, wherein said at least one timing spring has an end which faces away from said timing plunger supported on a spring retainer; and wherein said actuating plunger is arranged to engage and displace said spring retainer when the actuating plunger is displaced with said diaphragm membrane beyond said predetermined displacement.

14. In a fuel supply system for an internal combustion engine according to claim 8, wherein said delayed action means comprises first and inner plungers mounted for reciprocation within said timing plunger, said inner plungers being spring-loaded toward each other into a neutral position in which one end of the first inner plunger faces an inner chamber within said timing valve plunger and an opposite end of said second inner plunger is positioned at a predetermined distance from an inner plunger stop; wherein a controlled leakage path is provided for leaking a portion of timing fluid flowing from said timing fluid inlet to said timing fluid outlet into a cavity area between the first and second inner plungers; wherein said leakage path and said predetermined distance are set for causing timing fluid leaked along said path into said inner chamber to displace said second inner plunger into engagement with said inner plunger stop and then to act upon said timing valve plunger in opposition to said rail pressure after a predetermined time period; and wherein drain means is provided for draining timing fluid from said cavity area whenever the pressure therein exceeds said unrestricted rail pressure.

15. In a fuel supply system for an internal combustion engine according to claim 8, wherein the timing valve is located in a common housing with an engine torque curve shaping pressure regulator means for controlling the pressure of fuel supplied to the fuel injectors by said first supply rail; and wherein an outlet of the pressure regulator means is connected to said axial bore for providing said communication between the first supply rail and the second end of the timing valve plunger.

16. In a fuel supply system for an internal combustion engine according to claim 15, wherein said pressure regulator means comprises a second variable orifice means for controlling the pressure of fuel in said first supply rail as a function of unrestricted rail pressure.

17. In a fuel supply system for an internal combustion engine according to claim 16, wherein said pressure regulator means comprises a second valve barrel having a second axial bore and an regulator valve plunger mounted for reciprocation within the second axial bore, a regulator spring acting on a first end of the regulator valve plunger, and an opposite, second end of the regulator valve is vented to atmospheric pressure; wherein a rail pressure outlet of the supply pump is connected to a rail supply fuel inlet at a first location along the length of the second axial bore and said first supply rail is connected to a supply rail fuel outlet at a second location that is axially spaced along the length of the second axial bore relative to said first location; wherein said regulator valve plunger and said fuel outlet coact to form said second variable orifice means for varying a flow-through cross section for fuel traveling from said rail supply fuel inlet to said supply rail fuel outlet as a function of movement of said regulator plunger toward and away from said first and second locations, whereby the position of the regulator plunger in the second axial bore, and therefore, the flow-through cross section of the second variable orifice means, is a function of unrestricted rail pressure, and spring rate and spring preload of said regulator spring.

18. In a fuel supply system for an internal combustion engine according to claim 1, wherein said timing valve is located in a common housing with an engine torque curve shaping pressure regulator means for controlling the pressure of fuel supplied to the fuel injectors by said first supply rail; and wherein an outlet of the pressure regulator means is connected to said axial bore for providing said communication between the first supply rail and the second end of the timing valve plunger.

19. In a fuel supply system for an internal combustion engine according to claim 18, wherein said pressure regulator means comprises a second variable orifice means for controlling the pressure of fuel in said first supply rail as a function of unrestricted rail pressure.

20. In a fuel supply system for an internal combustion engine according to claim 19, wherein said pressure regulator means comprises a second valve barrel having a second axial bore and an regulator valve plunger mounted for reciprocation within the second axial bore, a regulator spring acting on a first end of the regulator valve plunger, and an opposite, second end of the regulator valve is vented to atmospheric pressure; wherein a rail pressure outlet of the supply pump is connected to a rail supply fuel inlet at a first location along the length of the second axial bore and said first supply rail is connected to a supply rail fuel outlet at a second location that is axially spaced along the length of the second axial bore relative to said first location; wherein said regulator valve plunger and said fuel outlet coact to form said second variable orifice means for varying a flow-through cross section for fuel traveling from said rail supply fuel inlet to said supply rail fuel outlet as a function of movement of said regulator plunger toward and away from said first and second locations, whereby the position of the regulator plunger in the second axial bore, and therefore, the flow-through cross section of the second variable orifice means, is a function of unrestricted rail pressure, and spring rate and spring preload of said regulator spring.

21. In a fuel supply system for an internal combustion engine according to claim 1, wherein said variable orifice means comprises an internal groove at an inner end of said timing fluid outlet and a tapered peripheral surface on said timing valve plunger, said variable flow-through cross section being defined by a radial gap between the said internal groove and the tapered peripheral surface of said plunger.

* * * * *